United States Patent [19]

Hayward

[11] Patent Number: 4,484,535

[45] Date of Patent: Nov. 27, 1984

[54] HANDBELL CLAPPER

[75] Inventor: Gamon B. Hayward, Escondido, Calif.

[73] Assignee: Maas-Rowe Carillons, Inc., Escondido, Calif.

[21] Appl. No.: 477,232

[22] Filed: Mar. 21, 1983

[51] Int. Cl.[3] ..... G10K 1/071; G10K 1/10; G10K 1/36; G10D 13/08

[52] U.S. Cl. ..... 116/171; 84/406; 116/149; 116/156

[58] Field of Search ..... 116/148–150, 116/152, 155–157, 163, 167, 170, 171, 172, 151; 84/103, 406, 407

[56] References Cited

U.S. PATENT DOCUMENTS

| | | | |
|---|---|---|---|
| 159,411 | 2/1875 | Hawkins et al. | 116/156 |
| 3,139,855 | 7/1964 | Kunz | 116/171 |
| 3,941,082 | 3/1976 | Malta | 116/171 |
| 3,945,340 | 3/1976 | Yanagisawa | 116/157 |

*Primary Examiner*—Charles Frankfort
*Assistant Examiner*—W. Morris Worth
*Attorney, Agent, or Firm*—Flam & Flam

[57] ABSTRACT

A clapper body individually mounts two striker turrets on opposite ends. Each striker turret carries individual striker heads and is angularly movable on a turret platform tilted sufficiently in the swing plane so that only the head closest the bell mouth is operative.

4 Claims, 4 Drawing Figures

HANDBELL CLAPPER

FIELD OF INVENTION

This invention relates to handbells, and particularly to a clapper having a number of selectively operable striking heads.

BACKGROUND OF THE INVENTION

Handbell clappers having a number of selectively operable striking heads are exemplified in the prior art by U.S.A. Patents to Jacob H. Malta, U.S. Pat. Nos. 3,941,082, issued Mar. 2, 1976, entitled HANDBELL, and 3,253,574, issued May 31, 1966, entitled BELL. Both patents disclose a clapper angularly movable about the longitudinal axis of the clapper bar in order to position pairs of striking heads for engagement with the bell. The bell action is symmetrical, that is to say, the bell sound is the same in both the front and back swing directions since each of the pair of striking heads is the same.

An object of the present invention is to add a new dimension of versatility to a handbell by making it possible to select modes of operation of the bell in which the front and back swings of the handbell are either the same or different, as desired by the user. Another object of this invention is to accomplish this new function by a simple structural arrangement.

SUMMARY OF INVENTION

In order to accomplish the foregoing objects, I provide a clapper body that individually mounts two striker turrets at opposite ends. Each striker turret is made of neoprene or other elastomeric material and carries three individual striker heads of different compliance or impact characteristic. The turret platform provided by the clapper body is angled sufficiently in the swing plane so that only the striker head closest to the mouth of the handbell is projected to be operative while the other striker heads are relatively retracted. A non-circular or hexagonal hole in each turret cooperates with corresponding mounting projection of the clapper body whereby stable angular positions of the turret are determined corresponding to proper positioning of one of the striker heads. The turrets at opposite ends can be individually adjusted to provide paired or equal bell action for both front and back swings, or adjusted for non-paired and disparate bell action for front and back swings.

BRIEF DESCRIPTION OF THE DRAWINGS

A detailed description of the invention will be made with reference to the accompanying drawings wherein like numerals designate corresponding parts in the several figures. These drawings are to scale.

DETAILED DESCRIPTION OF THE PREFERRED EMBODIMENT

The following detailed description is of the best presently contemplated mode of carrying out the invention. This description is not to be taken in a limiting sense, but is made merely for purposes of illustrating the general principles of the invention, since the scope of the invention is best defined by the appended claims.

Figure 1:
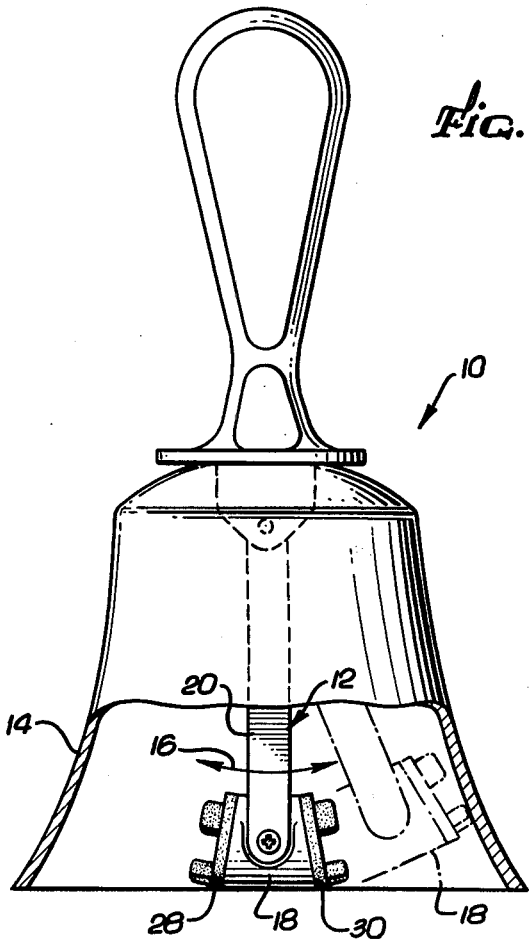
FIG. 1 is a side elevational view of a handbell incorporating the new clapper, part of the bell being broken away and shown in section in order to illustrate the clapper.
Figure 4:
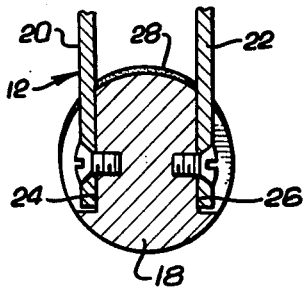
FIG. 4 is a sectional view through the clapper body, and taken along the plane indicated by line 4—4 of FIG. 2.

In FIG. 1, there is illustrated a handbell 10 having a clapper bar 12. By suitable means not shown, the clapper bar 12 is supported inside the bell head 14 for movement in a swing plane indicated by the double-headed arrow 16.

The clapper bar 12 carries a heavy clapper body 18 at its lower end. The clapper body 18 may be made from cylindrical brass stock material, or it may be made as a casting. In the present instance, the clapper bar 12 comprises a pair of spaced, parallel metal strips 20 and 22 attached at their outer ends to flats 24 and 26 on the sides of the clapper body 18.

Figure 2:
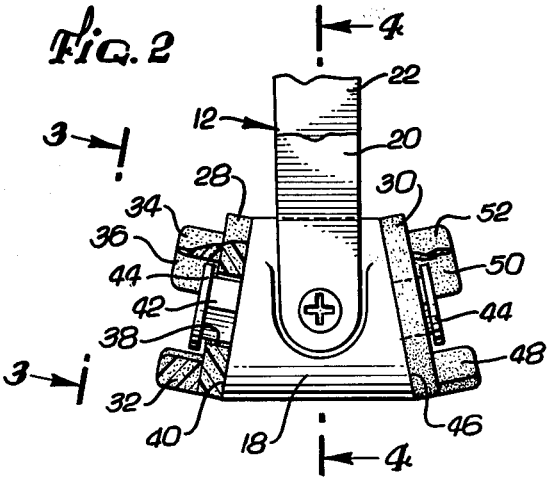
FIG. 2 is an enlarged side elevational view of the clapper striker itself, one of the striker heads being shown in section.

Two sets of bell striker heads are mounted at opposite ends of the clapper body 18. For this purpose, two like turrets 28 and 30 are provided. One of the turrets 28, as shown in FIG. 2, carries three striker heads 32, 34 and 36 arrayed equiangularly about a central aperture 38. The turret 28 is made of neoprene or other elastomeric material. The striker heads have individual strike or characteristics for soft, medium or hard engagement with the bell. The heads may be attached to the turret in any suitable manner.

The central aperture 38 of the turret 28 is non-circular, having a regular polygonal, in this instance, a hexagonal configuration. The aperture 38 serves as a means whereby the turret 28 is mounted at one end surface 40 of the clapper body 18.

Figure 3:
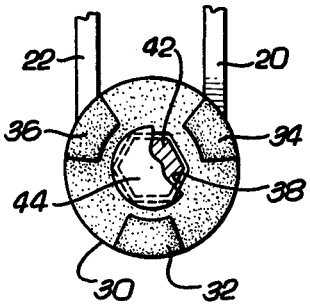
FIG. 3 is a front elevational view of one of the striker heads and taken in the plane indicated by line 3—3 of FIG. 2.

At the center of the end surface 40 is a projection 42 (FIGS. 2 and 3) of corresponding polygonal cross section, in this instance hexagonal, to fit the aperture 38. The projection has an overlying head 44 releasably to retain the turret 28 in place at the surface 40. The turret 28 can be moved angularly about the projection 42, but the resilience of the turret at the aperture 38 determines six stable positions. In one such position, the striker head 32 is located outermost of the swing axis of the clapper bar, in another such stable position, the striker head 34 is located outermost, and in still another position, the striker head 36 is located outermost.

It is the outermost striker head that is operative. To ensure that the other striker heads do not engage the bell, the surface 40 is angled back towards the swing axis of the clapper bar 12.

The turret 30 is identical to the turret 28, and is correspondingly mounted at an angled surface 46 at the opposite end of the clapper body 18. Striker heads 48, 50 and 52 of the turret 30 correspond in compliance or strike characteristics of the heads 32, 34 and 36 respectively. However, the striker heads of the respective turrets need not be positioned in pairs. Thus, the bell can operate with a hard strike in the forward direction and a soft strike in the back direction.

The turret arrangement locates the operative striker head near the plane of the mouth. Hence, the striker head engages the bell at a desired position to achieve appropriate ring characteristics.

Intending to claim all novel, useful and unobvious features shown or described, I make the following claims:

I claim:

1. In a handbell having a bell body and a handle attached to the bell body for imparting swinging movement thereto, the combination therewith of:

(a) a clapper bar;

(b) means supporting the clapper bar on said bell body for angular movement about a swing axis;

(c) a clapper body suspended at the end of said clapper bar, said clapper body having opposite end surfaces;

(d) a pair of turrets;

(e) a plurality of strike heads on each turret, and having different strike characteristics;

(f) means mounting said turrets on said end surfaces of said clapper body respectively for angular movement selectively to position one of the strike heads of the turret into operative position, thereby independently to determine both the forward and back strike characteristics of the handbell;

(g) each of said mounting means comprising a non-circular central projection extending from said end surface of said clapper body, the companion turret having a non-circular aperture fitting the projection in any one of a number of selected relative angular orientations;

(h) said projection and said aperture having a corresponding regular polygonal configuration;

(i) said turret, at the region of said aperture being resilient whereby stable positions of said turret are determined corresponding to operative positioning of one of the strike heads of the corresponding turret.

2. In a handbell having a bell body and a handle attached to the bell body for imparting swinging movement thereto, the combination therewith of:

(a) a clapper bar;

(b) means supporting the clapper bar on said bell body for angular movement about a swing axis;

(c) a clapper body suspended at the end of said clapper bar, said clapper body having opposite end surfaces;

(d) a pair of turrets;

(e) a plurality of strike heads on each turret, and having different strike characteristics;

(f) means mounting said turrets on said end surfaces of said clapper body respectively for angular movement selectively to position one of the strike heads of the turret into operative position, thereby independently to determine both the forward and back strike characteristics of the handbell;

(g) said end surfaces being angled towards the swing axis to ensure that non-positioned strike heads of the turret are maintained out of engagement with the handbell while the positioned strike head is located outermost in the swing movement of the clapper bar.

3. The handbell as set forth in claim 2 in which each of said mounting means comprises a central projection extending from said end surface of said clapper body, the companion turret having an aperture fitting the projection.

4. The handbell as set forth in claim 3 in which said projection and said aperture have a corresponding regular polygonal configuration, and said turret, at the region of said aperture, being resilient whereby stable positions of said turret are determined corresponding to operative positioning of one of the strike heads of the corresponding turret.

* * * * *